United States Patent [19]

Jahn

[11] Patent Number: 4,722,273

[45] Date of Patent: Feb. 2, 1988

[54] WASHING DEVICE FOR WASHING A RUBBER BLANKET IN A ROTARY OFFSET PRINTING PRESS

[75] Inventor: Hans-Georg Jahn, Wiesenbach, Fed. Rep. of Germany

[73] Assignee: Heidelberger Druckmaschinen AG, Heidelberg, Fed. Rep. of Germany

[21] Appl. No.: 835,654

[22] Filed: Mar. 3, 1986

[30] Foreign Application Priority Data

Mar. 1, 1985 [DE] Fed. Rep. of Germany ..... 3507210

[51] Int. Cl.[4] ..... B41F 7/06; B41F 35/06

[52] U.S. Cl. ..... 101/142; 101/425

[58] Field of Search ..... 101/425, 423, 217, 350, 101/364, 366, 137, 142, 143, 144

[56] References Cited

U.S. PATENT DOCUMENTS

| | | | |
|---|---|---|---|
| 3,896,730 | 7/1975 | Garrett et al. | 101/425 |
| 4,270,450 | 6/1981 | Difflipp et al. | 101/425 |
| 4,308,796 | 1/1982 | Satterwhite | 101/217 |
| 4,369,734 | 1/1983 | Preuss | 101/425 |
| 4,526,102 | 7/1985 | Grobman | 101/425 |

*Primary Examiner*—J. Reed Fisher

*Attorney, Agent, or Firm*—Herbert L. Lerner; Laurence A. Greenberg

[57] ABSTRACT

A washing device for washing a rubber blanket cylinder in a rotary offset printing machine, the washing device being convertible to a device for applying lacquer to the rubber blanket, the washing device being disposed at the blanket cylinder upstream of a location of contact between the blanket cylinder and a printing-image carrier, as viewed in direction of rotation of the blanket cylinder, the washing device having a metering roller, a spray device located adjacent to the metering roller, and a washing roller engageable with the metering roller and being disposed in a collecting vessel, including a washing-liquid supply container and a water supply container and valve means for alternatively feeding washing liquid and water from the respective container to the spray device, the metering roller of the washing device, when the washing device is converted to the lacquer applying device, serving as a lacquer metering roller and being engageable with the blanket cylinder in one printing unit of the rotary offset printing machine which does not participate in the printing operation, and the collecting vessel being replaced by a lacquer trough.

4 Claims, 1 Drawing Figure

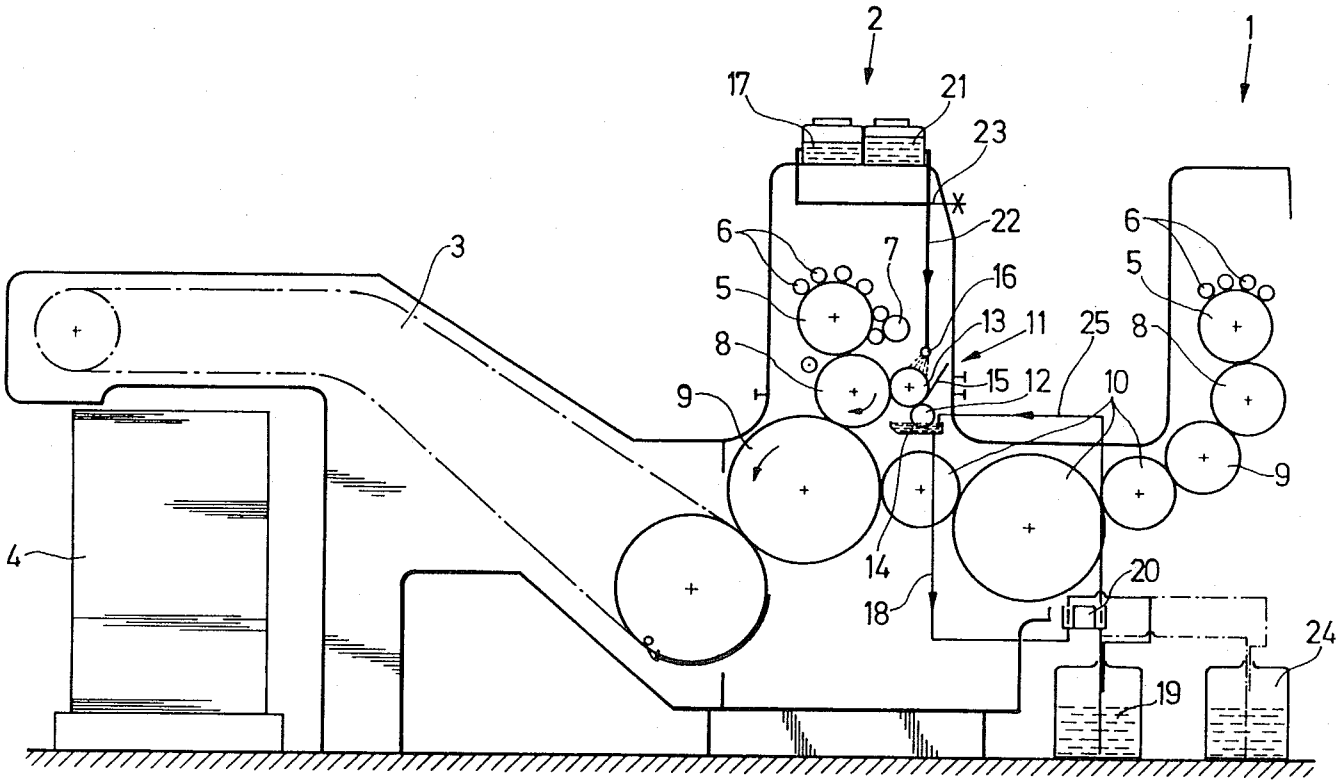
1
2
3
4
5
6
7
8
9
10
11
12
13
14
15
16
17
18
19
20
21
22
23
24
25

WASHING DEVICE FOR WASHING A RUBBER BLANKET IN A ROTARY OFFSET PRINTING PRESS

The invention relates to a washing device for washing a rubber blanket of a blanket cylinder in a rotary offset printing press and, more particularly, to such a washing device which is convertible to a device for applying lacquer to the rubber blanket, the washing device being disposed at the blanket cylinder upstream of a location of contact between the blanket cylinder and a printing-image carrier, as viewed in direction of rotation of the blanket cylinder, the washing device having a metering roller, a spray device located adjacent to the metering roller, and a washing roller engageable with the metering roller and being disposed in a collecting vessel.

Such washing devices are associated with the rubber blanket cylinder and their purpose is to wash the rubber blanket and possibly also the printing plate and the impression cylinder after a given number of printings to enable ink residue and dirt particles to be removed as disclosed, for example, in German Published Non-Prosecuted Application No. (DE-OS) 25 31 886. For this purpose, the washing device is mounted in the side frames of the printing machine and can be moved into engagement with a rubber blanket cylinder during the washing operation. Solvent or water is selectively supplied during this period. Dirty washing liquid discharges into a collecting vessel into which ink residues which have been scraped off the metering roller by a doctor blade are also discharged. The washing device itself is normally formed of two rollers, namely a washing roller, which is constructed to spread the washing liquid by rubbing, and a metering roller which is engageable with the rubber blanket.

In printing technology, it is conventional to use dampening units for lacquering or even to provide separate lacquering units (German Patent No. 20 20, 584). A disadvantage of the latter heretofore known embodiment is that the dampening unit is operatively associated with the plate cylinder so that the surfaces of the plate and rubber blanket cylinders become provided with lacquer. The long distance required to be traversed in this case in order to apply the lacquer promotes the drying thereof so that these cylinders must be washed often. Moreover, there is a risk that the inking or ink applying rollers which are swivelled away may become soiled by lacquer. If a separate lacquering unit is provided at the rubber blanket cylinder, however, access to the cylinders is very severely impaired. If it is assumed that four inking or applicator rollers and a dampening unit are operatively associated with the plate cylinder, and a washing device and a lacquering unit with the rubber blanket cylinder, it is then not possible for the printer to replace the printing plate or the rubber blanket in a simple manner without lengthy and involved disassembly work. Heretofore, this problem had been dealt with by removing the washing device and installing the lacquering unit in place thereof. A disadvantage resulting therefrom, however, is that the last printing unit must then be washed manually.

Proceeding from this state of the art, it is an object of the invention to provide a washing device for a rubber blanket in a rotary offset printing press which is convertible to a device for also applying lacquer to the rubber blanket of the rubber blanket cylinder and thus also to the printing image carrier. In this case, the plate cylinder and the dampening unit and the inking unit are mutually disengaged, and only the rubber blanket and impression cylinders are mutually engaged.

With the foregoing and other objects in view, there is provided, in accordance with the invention, a washing device for washing a rubber blanket cylinder in a rotary offset printing machine, the washing device being convertible to a device for applying lacquer to the rubber blanket, the washing device being disposed at the blanket cylinder upstream of a location of contact between the blanket cylinder and a printing-image carrier, as viewed in direction of rotation of the blanket cylinder, the washing device having a metering roller, a spray device located adjacent to the metering roller, and a washing roller engageable with the metering roller and being disposed in a collecting vessel, comprising a washing-liquid supply container and a water supply container and valve means for alternatively feeding washing liquid and water from the respective container to the spray device, the metering roller of the washing device, when the washing device is converted to the lacquer applying device, serving as a lacquer metering roller and being engageable with the blanket cylinder in one printing unit of the rotary offset printing machine which does not participate in the printing operation, and the collecting vessel being replaced by a lacquer trough.

A principal benefit of the device according to the invention is that the rapidly drying lacquer is transferred over the shortest path to the printing-image carrier. Moreover, there is no risk that the dampening unit or the inking unit will become dirtied by lacquer and will require cleaning in an involved and complicated manner. If the printing unit is used for printing, the washing device is disengaged so that there is no changer of the print being dirtied by lacquer residues even following a preceding lacquering operation. Whenever it is necessary, the printer can also wash the last printing unit mechanically in a customary manner. In this regard, the spray equipment allocated to the washing device can also be used for washing the rollers during lacquering.

In accordance with another feature of the invention, there is provided a lacquer supply container connectible via a pump to the lacquer trough, the lacquer trough having an overflow for limiting lacquer level in the lacquer trough, and a water supply container connectible via the pump for filling the lacquer trough with water after the lacquer has been pumped out of the lacquer trough.

In accordance with an additional feature of the invention, there is provided a lacquer dipping roller for replacing the washing roller, the lacquer dipping roller having a non-rubbing and non-distributive cylindrical surface, and the washing roller having a distributively rubbing cylindrical surface.

In accordance with an added feature of the invention, the lacquer dipping roller has a cylindrical surface with a covering formed of rubber.

In accordance with a concomitant feature of the invention, there is provided an electric motor for driving the washing roller, the electric motor being switchable on for a brief period and the metering roller being briefly engageable with the rubber blanket, during operation of the washing device and after the washing device has been converted to the lacquer-applying device, the lacquer dipping roller being drivable with controllable speed, and the lacquer metering roller being engaged with the blanket cylinder, the washing device also including a function switch for effecting the conversion of the washing device to the lacquer-applying device.

Other features which are considered as characteristic for the invention are set forth in the appended claims.

Although the invention is illustrated and described herein as embodied in a washing device for washing a rubber blanket in a rotary offset printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying single figure of the drawing which is a diagrammatic side elevational view of a printing unit with a convertible washing and lacquering device.

Referring now to the drawing, there is shown therein a rotary offset printing press used for printing sheets and having several printing units 1, 2 from which the printed sheets are fed to a delivery pile 4 by means of a chain conveyor delivery system 3. Each printing unit 1, 2 is formed, in a conventional manner, of a plate cylinder 5 with which an inking unit 6 and a dampening unit 7 are operatively associated, a rubber or blanket cylinder 8 and an impression cylinder 9. The sheets to be printed are transferred by means of transfer drums 10 from one impression cylinder 9 to the other. The last impression cylinder 9 in the printing unit 2 then transfers the sheets contact-free to the chain delivery 3.

A washing device 11 for the rubber blanket of the cylinder 8 is operatively engaged with the blanket cylinder 8 in the direction of rotation ahead of or upstream of a contact point thereof with the impression cylinder 9, as viewed in direction of rotation of the blanket cylinder 8. This washing device 11 includes a washing roller 12 and a metering roller 13. The washing roller 12 is provided with a collecting vessel 14 for dirty cleaning liquid, and the metering roller 13 can be provided with a doctor blade 15. In addition, the metering roller 13 has a spray device 16 associated therewith which is selectively supplied by means of a valve 23 with water from a vessel 17 or solvent from a vessel 21. In this regard, the metering roller 13 can be mounted so as to be engageable with the blanket cylinder 8, for washing the rubber blanket. During the period in which printing is being performed, the suitably movably mounted metering roller 13 is lifted away from the rubber blanket and a drive operatively connected to the washing roller 12 is shut down, the washing operation being able to be performed automatically by actuating a switch.

If the washing device 11 according to the invention of the instant application is used for lacquering, the inking unit 6 and the dampening unit 7 are moved away from the plate cylinder 5, the plate cylinder with the dampening and inking units being decouplable from the machine drive. The control of the metering roller 13 is switched over or converted by means of a switch in a "lacquering mode" to enable the metering roller 13 to be moved into engagement with the blanket cylinder 8 during the lacquering operation. The printing unit 2 does not participate in printing the sheets with a particular ink color when this setting is selected.

In the lacquering device 11 thus converted from the washing device 11, the metering roller 13 receives lacquer, which is to be transferred from a lacquer dipping roller 12 which replaces the washing roller 12. Such a replacement is recommended because both rollers may differ, for example, in the nature or structure of the outer cylindrical casing thereof. For lacquering, a rubber-coated lacquer dipping roller 12 is most suitable. Furthermore, the collecting vessel 14 for the dirty washing liquid, which is itself usually dirty and may possibly be provided with a drain or discharge into another vessel, is replaceable by a lacquer trough 14. The lacquer trough 14 is then connected by a feed line 25 to a lacquer supply vessel 19 and is continuously supplied with a flow of lacquer by a pump 20 so that the lacquer dipping roller 12 dips into the fluid lacquer. The quantity of lacquer to be supplied is controlled by varying the rotary speed of the lacquer dipping roller 12, which is driven by a motor, and may, if desired, be further reduced, for example, zonewise, by means of the doctor blade 15.

Because it is also necessary to wash the blanket cylinder 8 and the lacquering unit 11 following the lacquering operation, the vessel 17 is provided with water which is fed by means of a feedline 22 to a spray device 16. The feedline 22 is connectible to the vessel 17 by means of a valve 23. The water in the vessel 17 can be applied via the spray device 16 to the lacquer metering roller 13, enabling the water-soluble lacquer to be removed from the rubber blanket of the blanket cylinder 8, the metering roller 13 and the lacquer dipping roller 12. In addition, it is possible to drain the lacquer trough 14 via the pump 20 and, likewise, pump water from the vessel 24 into the lacquer trough 14. This circulation of water cleans and removes lacquer residues from the entire pump system and the rollers.

The lacquer dipping roller 12 is driven by a non-illustrated electric motor so that it can be turned on briefly when it is used as a washing device, the metering roller 13 being simultaneously brought into engagement with the rubber blanket cylinder 8. During the lacquering operation, the electric motor can drive the lacquer dipping roller 12 with a variable speed so as thereby to control the quantity of lacquer supplied. The conversion of the electric motor from one to the other operating mode can be effected by means of a conventional function switch, by means of which also the spray device 16 and the pump 20 can be coupled so that a printer can readily start or switch on a washing process for the rubber blanket, for example, during printing, and alternatively switch on the lacquering device or the washing of the lacquering device.

The foregoing is a description corresponding in substance to German Application No. P 35 07 210.5, dated Mar. 1, 1985, the International priority of which is being claimed for the instant application, and which is hereby made part of this application. Any material discrepancies between the foregoing specification and the aforementioned corresponding German application are to be resolved in favor of the latter.

I claim:

1. A convertible washing and lacquering device for selectively washing and applying lacquer to a rubber blanket cylinder in a rotary offset printing machine, the device being disposed at the blanket cylinder upstream of a location of contact between the blanket cylinder and a printing-image carrier, as viewed in direction of rotation of the blanket cylinder, the device comprising a metering roller, a spray device located adjacent to the metering roller, a washing roller engageable with the metering roller and being disposed in a collecting vessel in a selected condition of the device wherein the rubber blanket cylinder is being washed, and a washing-liquid supply container and a water supply container and valve means for alternatively feeding washing liquid and water from the respective container to the spray device in said washing condition, said metering roller in a selected condition of the device wherein lacquer is being applied to the rubber blanket cylinder, being engageable with the blanket cylinder in one printing unit of the rotary offset printing machine which does not participate in the printing operation, and a lacquer trough for replacing said collecting vessel in said lacquer-applying condition, for supplying lacquer to said metering roller.

2. Device according to claim 1 including a lacquer dipping roller for replacing the washing roller in said lacquer-applying condition, said lacquer dipping roller having a non-rubbing cylindrical surface, and said washing roller having a rubbing cylindrical surface.

3. Device according to claim 2 wherein said lacquer dipping roller has a cylindrical surface with a covering formed of rubber.

4. Device according to claim 2 including an electric motor for driving the washing roller, said electric motor being switchable on for a brief period and the metering roller being briefly engageable with the rubber blanket, during the selected washing condition and, after selecting the lacquer-applying condition, said lacquer dipping roller being drivable with controllable speed, and said metering roller being engaged with the blanket cylinder, and further including a function switch for effecting alternate selection of the washing and lacquer-applying conditions respectively.

* * * * *